US010322057B2

(12) United States Patent
Black

(10) Patent No.: US 10,322,057 B2
(45) Date of Patent: Jun. 18, 2019

(54) FASCIA TISSUE FITNESS DEVICE

(71) Applicant: Ashley D. Black, Friendswood, TX (US)

(72) Inventor: Ashley D. Black, Friendswood, TX (US)

(73) Assignee: Ashley Diana Black International Holdings, LLC, Friendswood, TX (US)

( * ) Notice: Subject to any disclaimer, the term of this patent is extended or adjusted under 35 U.S.C. 154(b) by 74 days.

(21) Appl. No.: 14/188,143

(22) Filed: Feb. 24, 2014

(65) Prior Publication Data

US 2014/0243718 A1 Aug. 28, 2014

Related U.S. Application Data

(60) Provisional application No. 61/768,250, filed on Feb. 22, 2013.

(51) Int. Cl.
*A61H 7/00* (2006.01)
*A61H 39/04* (2006.01)

(52) U.S. Cl.
CPC ..... *A61H 7/003* (2013.01); *A61H 7/001* (2013.01); *A61H 7/007* (2013.01); *A61H 39/04* (2013.01); *A61H 2201/0153* (2013.01); *A61H 2201/1253* (2013.01); *A61H 2205/06* (2013.01); *A61H 2205/081* (2013.01); *A61H 2205/10* (2013.01); *A61H 2205/106* (2013.01); *A61H 2205/12* (2013.01); *A61H 2207/00* (2013.01); *Y10T 29/49826* (2015.01)

(58) Field of Classification Search
CPC ..... A61H 7/003; A61H 7/007; A61H 7/001; A61H 7/00; A61H 2205/06; A61H 2205/106; A61H 2205/12; A61H 2201/1253; A61H 2201/0153; A61H 2207/00; A61H 2205/10; A61H 2205/081; A61H 7/002; A61H 7/004; A61H 2007/009; A61H 2201/1692; A61H 2201/1695
USPC ..... D24/211–215
See application file for complete search history.

(56) References Cited

U.S. PATENT DOCUMENTS

| | | | | | |
|---|---|---|---|---|---|
| 912,016 | A * | 2/1909 | Miller | A61H 7/004 | 601/85 |
| 965,564 | A * | 7/1910 | Coates | A61H 7/001 | 132/76.4 |
| 1,713,756 | A * | 5/1929 | Hassler | A61H 7/002 | 15/188 |
| 2,972,347 | A * | 2/1961 | McNair | A61H 23/0218 | 601/120 |
| 4,493,315 | A * | 1/1985 | Iwahashi | A61H 7/001 | 601/135 |

(Continued)

FOREIGN PATENT DOCUMENTS

| | | | | |
|---|---|---|---|---|
| EP | 2311426 A1 | 4/2011 | | |
| WO | WO 2007051233 A1 * | 5/2007 | | A61H 39/04 |

OTHER PUBLICATIONS

International Search Report and Written Opinion for corresponding PCT/US2014/018043 dated May 6, 2014.

*Primary Examiner* — Michael J Tsai
*Assistant Examiner* — Tu A Vo
(74) *Attorney, Agent, or Firm* — Dentons US LLP

(57) ABSTRACT

A fascia tissue fitness device including a bar and a plurality of flower members connected to the bar along a plane. The flower members may each include multiple finger members that are stiff and extend outward from the bar.

29 Claims, 3 Drawing Sheets

(56) References Cited

U.S. PATENT DOCUMENTS 5,103,809 A * 4/1992 DeLuca ..... A61H 7/001 601/133
D384,157 S * 9/1997 Kusnets ..... D24/211
5,730,708 A * 3/1998 Spratt ..... A61H 7/003 601/118
D403,429 S * 12/1998 Blanchard ..... D24/211
D422,084 S * 3/2000 Mickelson ..... D24/211
6,241,693 B1 * 6/2001 Lambden ..... A61H 7/001 601/119
D447,809 S * 9/2001 Gladieux, III ..... D24/211
D473,657 S * 4/2003 Lewis-Jonsson ..... D24/211
D486,236 S * 2/2004 Nan ..... D24/215
6,758,826 B2 7/2004 Luettgen et al.
D515,702 S * 2/2006 Nan ..... D24/105
D556,913 S * 12/2007 Laituri ..... D24/214
D582,049 S * 12/2008 Ferber ..... D24/214
D627,897 S * 11/2010 Yde ..... D24/214
D633,217 S * 2/2011 Robertson ..... D24/215
8,337,438 B2 * 12/2012 Schupman ..... A61H 7/001 601/135
8,419,663 B2 * 4/2013 Eitzen ..... A61H 7/003 601/136
8,808,208 B2 * 8/2014 Mouatt ..... A61H 7/001 482/131
2002/0151930 A1 * 10/2002 Mills ..... A61H 39/04 606/204
2005/0096572 A1 * 5/2005 Hua ..... A61H 7/003 601/135
2007/0173750 A1 * 7/2007 Hudock ..... A61H 15/00 601/128
2008/0086066 A1 4/2008 Munday
2008/0255486 A1 * 10/2008 Ludlow ..... A61H 7/002 601/169
2010/0160841 A1 * 6/2010 Wu ..... A61H 7/004 601/135
2010/0191161 A1 7/2010 Mouatt
2011/0054369 A1 * 3/2011 DeStefano ..... A61H 7/001 601/135
2011/0087140 A1 * 4/2011 Lee ..... A61H 7/001 601/137
2011/0224588 A1 * 9/2011 Grippo ..... A61H 7/003 601/135
2012/0121313 A1 * 5/2012 Thiebaut ..... A61H 7/003 401/195
2013/0023807 A1 * 1/2013 Hennessey ..... A61H 7/003 601/119

* cited by examiner

FASCIA TISSUE FITNESS DEVICE

RELATED APPLICATIONS

This application claims priority to U.S. Provisional Application Ser. No. 61/768,250 filed Feb. 22, 2013, the contents of which are hereby incorporated by reference in their entirety.

BACKGROUND

Fascia tissue is a layer of fibrous tissue that operates as a connective tissue that surrounds muscles, groups of muscles, nerves, blood vessels, etc. The tissue allows for proper functioning of muscles with respect to one another (e.g., sliding past one another). When fascia tissue becomes damaged through injury, tissue knots, medical reasons, or otherwise, the fascia tissue can take time to correct itself or require manipulation to release the fascia tissue and allow for proper functioning of the tissue to allow the underlying muscle to properly operate. In some cases, the fascia tissue can be released or corrected without much difficulty, while in other cases, restoring the fascia tissue to its proper form can take considerably more effort. Other reasons for releasing fascia tissue may include cosmetic reasons, especially for people who have dimpled skin, which is often caused by fascia tissue extending through fat cells, thus causing dimples to appear on the skin. Often, when the fascia tissue is properly released, the dimples can be considerably reduced or eliminated.

SUMMARY

The principles of the present invention provide for a device configured to provide for fitness of fascia tissue. The device may include a bar along which "flower" members having a number of "finger" or "leg" members are fixedly positioned. In one embodiment, the bar may have handle regions at each end with a certain number, such as four, of flower members linearly positioned thereon. The bar and handle regions may be molded as a single piece of material. The handle regions may be defined by grippers formed of rubber or other material over the handle regions with protrusions to provide for additional gripping for a user. The handle regions may have the same or different circumference as the bar. The handle regions may be positioned about the width of human shoulders. The material of the flower members may be PVC, acrylic, or any other material that provides for rubbing across human skin without cutting or scratching. As a lubricant is generally used during usage of the device, a variety of different materials for the finger members may be utilized.

A fascia tissue fitness device may include a bar and multiple flower members connected to the bar along a plane. The flower members may each include multiple finger members that are stiff and extend outward from the bar.

One method of manufacturing a fascia tissue fitness device may include providing a bar, providing multiple flower members, and connecting the flower members to the bar.

BRIEF DESCRIPTION

A more complete understanding of the method and apparatus of the present invention may be obtained by reference to the following Detailed Description when taken in conjunction with the accompanying Drawings wherein.

DETAILED DESCRIPTION OF THE DRAWINGS

Figure 1:
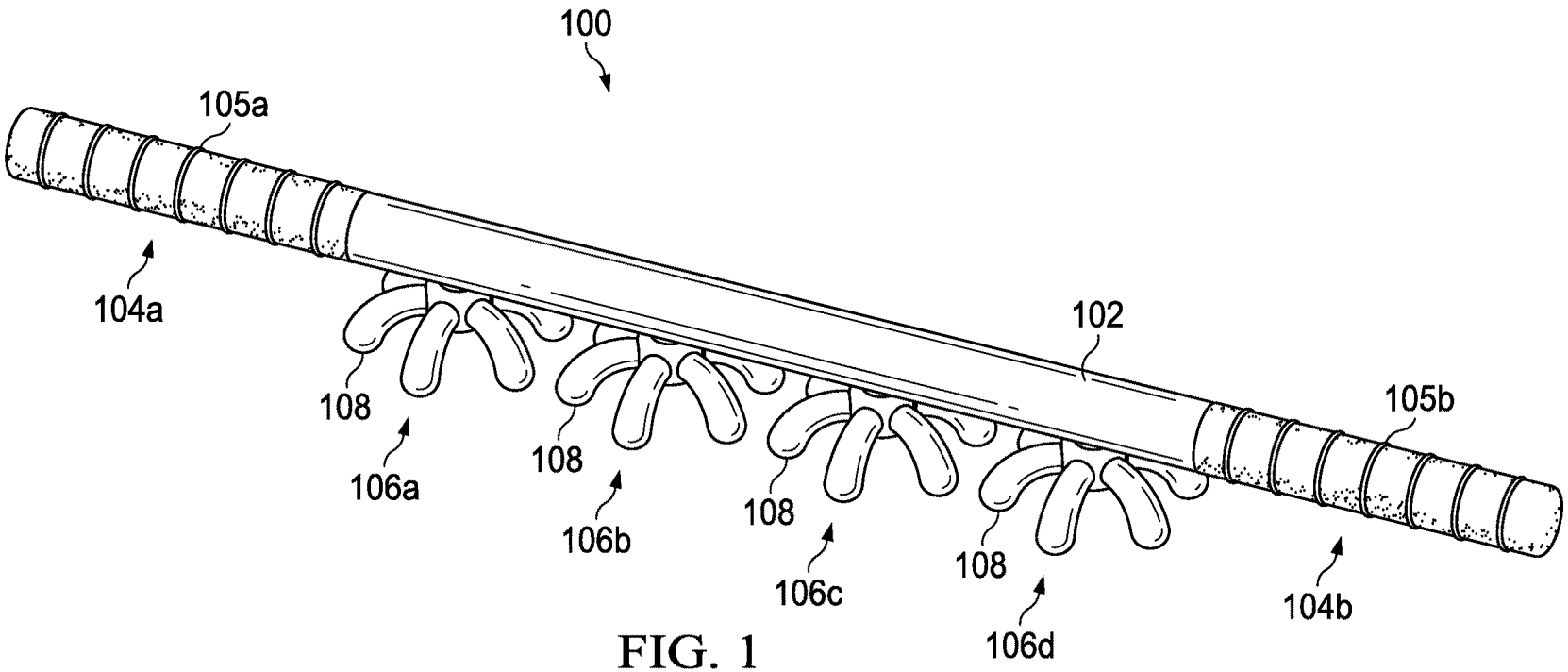
FIG. 1 is an illustration of a rear isometric view of an illustrative fascia tissue fitness device.

With regard to FIG. 1, an illustration of a rear isometric view of an illustrative fascia tissue fitness device 100 is shown. The device 100 may include a bar 102 having handle regions 104*a* and 104*b* (collectively 104). The handle regions 104 may have grippers 105*a* and 105*b* (collectively 105) formed or applied thereto. The grippers 105 may be formed of rubber or other material to provide gripping in a secure manner to prevent rotation of the bar 102. The handle regions 104 may have the same or different diameter as the bar 102. The length of the bar 102 may be such that the handle regions 104 are positioned about the distance of human shoulders (e.g., 30 inches). As such, there may be multiple lengths of the device 100. In one embodiment, the bar 102 may be extendible formed of one or more elements to be and use a variety of techniques for locking the element(s) to be a fixed length, thereby enabling people with different widths of shoulders to more easily use the device. As shown, however, the bar 102 and handle regions 104 are formed by a molding process that forms a single unit.

The bar 102 should be stiff or rigid, thereby minimizing bending during usages, such as self-usage. Although the bar 102 is shown to have a straight tube profile, it should be understood that alternative configurations of the bar 102 may be utilized in accordance with the principles of the present invention. For example, the bar may have a square profile, hexagonal profile, or another geometric or non-geometric profile. Still yet, the bar 102 may be curved, circular, oval, or otherwise to assist in better addressing different modalities and anatomical regions, such as backs, arms, calves, feet, and hands. In an alternative embodiment, rather than using a bar, a board (e.g., circular flat board) having flower members extending from one side of the board may be utilized in accordance with the principles of the present invention. To enable a user to use the board, a handgrip and/or hand strap connected to the board may be utilized in accordance with the principles of the present invention. Whether a support for the flower members 106 is in a bar, board, or other configuration, the principles of the present invention provide for the flower members 106 to be in a linear or non-linear alignment with respect to one another.

In one embodiment, and as shown, flower members 106*a*-106*d* (collectively 106) are shown to be mounted to the bar 102. The flower members 106 may be formed of acrylic, PVC, hard rubber, or any other material that is stiff and does not cut or scrape skin of a person on which the device 100 is being utilized to help treat or adjust fascia tissue. In the configuration of FIG. 1, there are four flower members. Alternative number of flower members may be utilized in accordance with the principles of the present invention. The flower members 106 are shown to be evenly spaced along a plane extending along the bar 102. Alternative spacing of the flower members 106 may be utilized in accordance with the principles of the present invention. The flower members 106 are also shown to be substantially identical. Alternative configurations of the flower members 106 may be utilized to provide for treating different size anatomical regions. It should be understood that a different number of flower members 106 may be utilized depending on the dimensions of the flower members 106 and other factors. In one embodiment, the bar 102 may have flower members 106 of different sizes so as to be available to treat different anatomical regions or different sized individuals. As an example, different sized flower members 106 may be positioned on opposite sides, for example of the bar 102 and facing away from one another to allow a single device to be used to treat the different anatomical regions and/or different sized individuals.

The flower members 106 shown are about 1½ inches in diameter. However, the diameter of the flower members 106 may have a fairly wide range (e.g., ½ inch to 4 inches in diameter). Illustrative finger members 108 shown are about ¾ of an inch long and have heads or tips that are about ⅜ of an inch across. The dimensions and configurations (e.g., curves) of the flower members 106, finger members 108, and tips of the finger members 108 may vary depending on the anatomical region on which the device 100 is to be used. The tips of the finger members 108 may have one or more same or different dimensions as the finger members (e.g., the tips may have a larger diameter by being bulbous). The finger members 108 are shown to be curved. Alternative configurations, such as finger members 108 being straight, may be utilized, as well. The flower members 106 are also shown to be a single member. However, flower members 106 may be formed of multiple elements. Still yet, rather than the device 100 using flower members 106 that have a flower-like appearance (i.e., central portion with extending finger members), flower members 106 with non-flower-like appearance may be utilized, as well, that still provides a user with a number of closely spaced pressure-point elements that can be pressed and guided along a person's skin to cause fascia tissue to be released or perform a non-therapeutic function. The finger members 108 may be substantially the same length (e.g., less than 0.1 inch difference in length between finger length) such that the tips of the finger members 108 are substantially co-planar so that a pressure load applied to the skin and fascia tissue is substantially equally applied by each of the finger members 108.

Each of the flower members 106 are shown to have six finger members 108. Alternative numbers of finger members 108 may be utilized in accordance with the principles of the present invention. The finger members 108 may be stiff or rigid, thereby having minimum bend or deformation during usage of the device on fascia tissue of a person. Although the flower members 106 are shown to extend along one side of the bar 102, additional flower members have the same or different configurations as the flower members 106 may be included to allow for a single device 100 to provide for different size and configuration of flower members to be used on different anatomical regions.

The bar 102 may have openings (not shown) defined by the bar 102 through which a screw or other fastening mechanism may extend through flower members 106 into the bar 102. After fastening the flower members 106 to the bar 102, glue or other fastening material, such as epoxy, may be utilized to secure the flower members 106 to the bar 102. A cover (not shown) above the fastening mechanisms may be utilized to limit the ability for someone to access or remove the fastening mechanisms of the flower members 106. Alternatively, the flower members 106 may be configured to allow for a user to more easily replace the flower members 106 to change size, replace broken flower members, or otherwise. Other attachments that may be flower members or non-flower members (e.g., roller) may also be connected to the bar 102 in accordance with the principles of the present invention.

Figure 2:
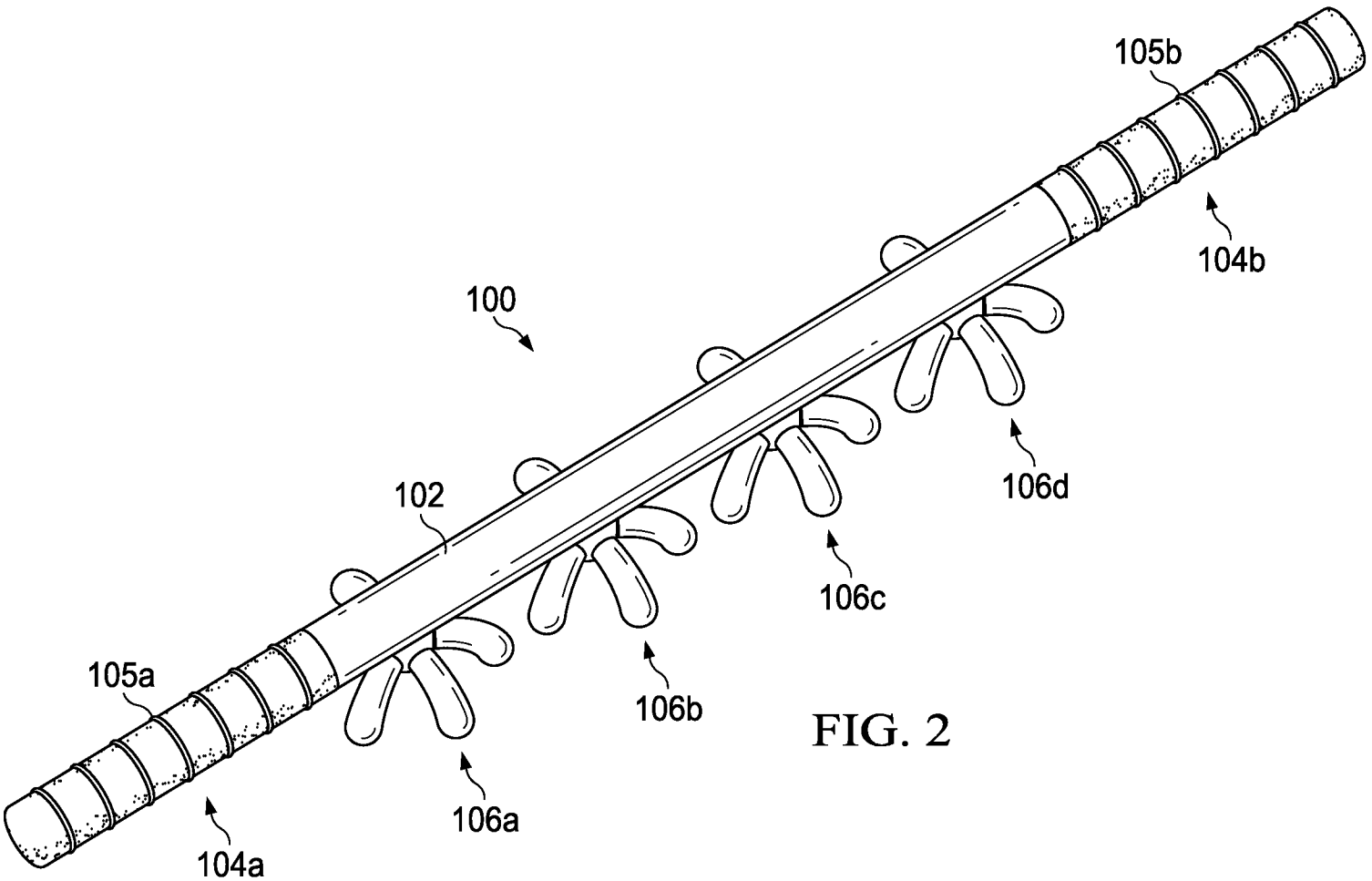
FIG. 2 is another illustration of a rear isometric view of the illustrative fascia tissue fitness device of FIG. 1.

FIG. 2 is another illustration of a rear isometric view of the illustrative fascia tissue fitness device 100 of FIG. 1.

Figure 3:
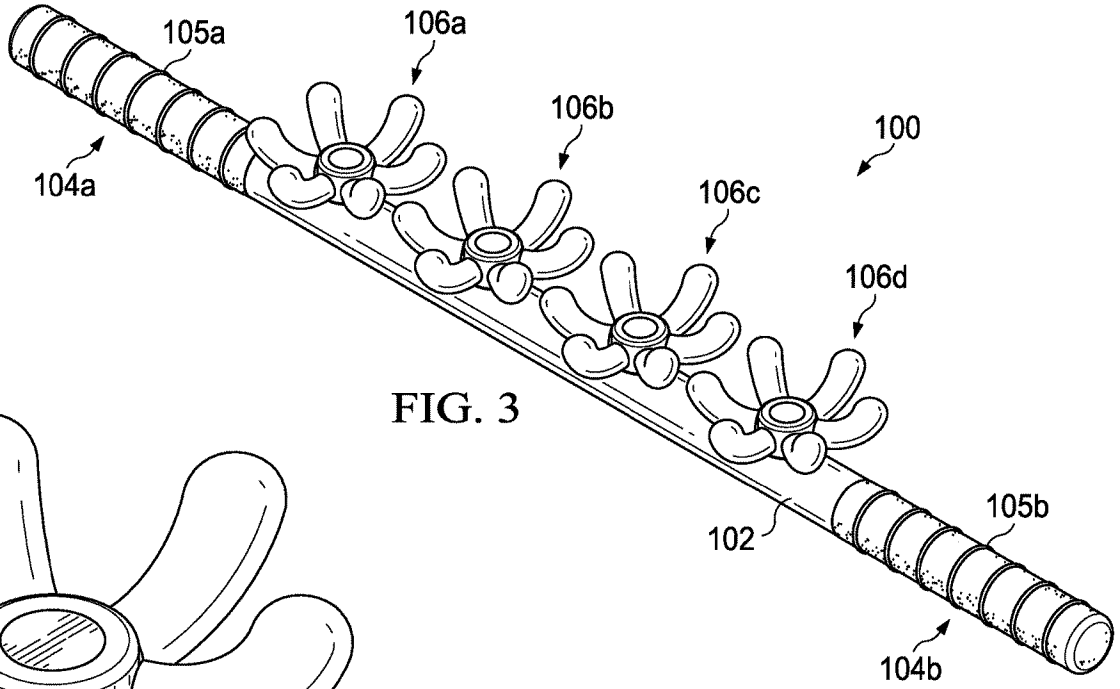
FIG. 3 is an illustration of a front isometric view of the illustrative fascia tissue fitness device of FIG. 1.

FIG. 3 is an illustration of a front isometric view of the illustrative fascia tissue fitness device 100 of FIG. 1.

Figure 4:
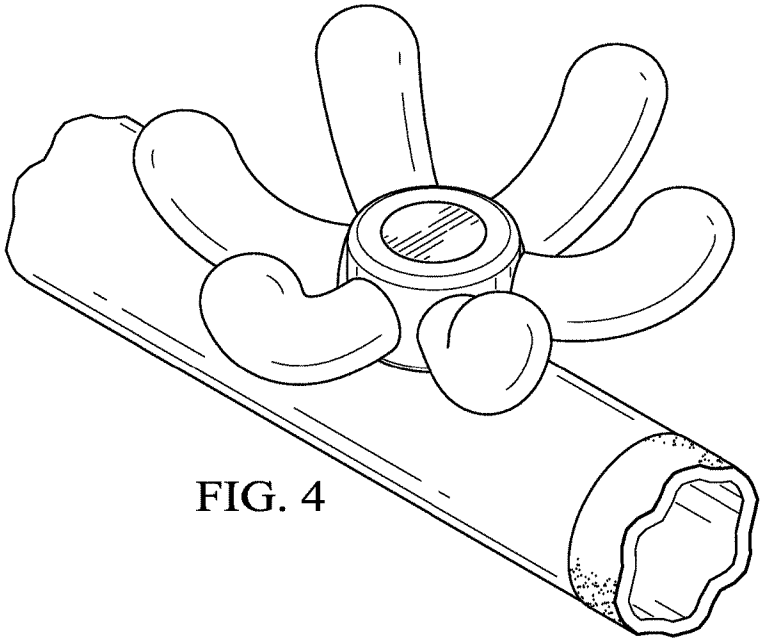
FIG. 4 is an illustration of a close-up view of a "flower" member mounted to the bar of the illustrative fascia tissue fitness device of FIG. 1.

FIG. 4 is an illustration of a close-up view of a "flower" mounted to the bar of the illustrative fascia tissue fitness device of FIG. 1.

While certain features of the device 100 are configured to be optimal usage on fascia tissue, the features also provide for ornamental appearance. For example, the number of flower members 106, configuration of the bar 102, configuration of the handle regions 104, grippers 105, number of finger members 108 on the flower members 106, shape of the finger members 108, and so forth. As such, the overall and certain ornamental features are included in the device 102 in accordance with the principles of the present invention. It should be understood that utilizing the device 102 may be used for increasing overall myo-fascial fitness to loosen fascia tissue that is constrained, improve health and/or beauty purposes (e.g., provide a satisfactory feeling to a user and/or alter the appearance of cellulite and skin smoothness). Moreover, usage of the fascia tissue fitness device may open, loosen, restore, and/or revitalize fascia tissue of men and women, young and old.

The previous description is of a preferred embodiment for implementing the invention, and the scope of the invention should not necessarily be limited by this description. The scope of the present invention is instead defined by the following claims.

What is claimed:

1. A fascia tissue fitness device, comprising:

a singular, linear, and uniformly tubular bar;

grippers extending along each end of said singular, linear, and uniformly tubular bar, thereby defining handle regions of said singular, linear, and uniformly tubular bar;

a plurality of flower members connected to said singular, linear, and uniformly tubular bar along a plane, the flower members each including a plurality of finger members, the flower members including a base extending from the bar and having a top surface and a side surface extending between the top surface and the bar, each of the finger members including a cylindrical shaft having a base portion and a tip portion, the base portion of the finger members extending from the side surface such that the base portion does not directly extend from the top surface, the base portion arcing toward the tip portion, the arc including a concave contour that extends from the side surface of the base to the tip portion of the finger members, and a convex contour that is opposite of the concave contour, and includes a curvature greater than a curvature of the concave contour, the convex contour extending from the side surface of the base to the tip portion of the finger members, thereby forming finger members that curve away from the base and the singular, linear, and uniformly tubular bar.

2. The device according to claim 1, wherein said plurality of flower members are four in number.

3. The device according to claim 1, wherein each of said flower members is about 1½ inches in diameter.

4. The device according to claim 1, wherein the plurality of finger members includes six finger members.

5. The device according to claim 1, wherein each of said flower members is substantially identical to one another.

6. The device according to claim 1, wherein said grippers include ridges that radially extend from and encircle said grippers.

7. The device according to claim 6, wherein said grippers include a rubber material.

8. The device according to claim 1, wherein a length of the bar is about a width of human shoulders.

9. The device according to claim 1, wherein said flower members are formed of acrylic.

10. The device according to claim 1, further comprising a screw to connect said plurality of flower members to said bar.

11. The device according to claim 1, wherein a portion of the shaft closest to the tip and tip of each of the finger members have substantially the same diameter.

12. The fascia tissue fitness device according to claim 1, wherein each of said flower members includes a base that extends from said linear bar in a substantially perpendicular direction.

13. The fascia tissue fitness device according to claim 12, wherein the finger members of the flower members extend radially from said base in a substantially perpendicular direction, and wherein tips of the finger members are oriented in the direction of the base relative to said bar.

14. The device according to claim 1, wherein the base is a cylindrical base.

15. The device according to claim 1, wherein the base portion of the finger members are offset below the top surface and above the bar such that the base portion does not directly extend from the top surface of the base.

16. A method of manufacturing a fascia tissue fitness device, comprising:

providing a singular, linear, and uniformly tubular bar over a first region;

providing grippers extending along said singular, linear, and uniformly tubular bar at each end of said singular, linear, and uniformly tubular bar, thereby defining handle regions;

providing a plurality of flower members, each of the flower members including a plurality of finger members that are stiff and extend outward from the bar, the plurality of finger members having a shaft defined by a portion extending from a base end to a tip end, the shaft of the finger members being curved along a substantial portion of the shaft in an axial direction, each of the flower members including a base extending from the bar and having a top surface and a side surface extending between the top surface and the bar, the finger members including a cylindrical shaft having a base portion and a tip portion, the base portion of the finger members extending from the side surface such that the base portion does not directly extend from the top surface, the base portion arcing toward the tip portion, the arc including a concave contour that extends from the side surface of the base to the tip portion of the finger members, and a convex contour that is opposite of the concave contour, and includes a curvature greater than a curvature of the concave contour, the convex contour extending from the side surface of the base to the tip portion of the finger members, thereby forming finger members that curve away from the base and the singular, linear, and uniformly tubular bar; and connecting the plurality of flower members to the singular, linear, and uniformly tubular bar over the first region.

17. The method according to claim 16, wherein connecting the plurality of flower members to the bar includes connecting screws through center portions of the flower members and into openings defined by the bar to attach the flower members to the bar.

18. The method according to claim 16, wherein connecting the plurality of flower members to the bar include connecting the plurality of flower members to one side of the bar such that each of the flower members face the same direction.

19. The method according to claim 16, wherein providing the plurality of flower members includes providing a plurality of flower members having the same dimensions.

20. The method according to claim 16, wherein providing a plurality of flower members includes providing four flower members, and connecting the four flower members to one side of the bar.

21. The method according to claim 16, further comprising applying grips to handle regions of the bar.

22. The method according to claim 16, wherein providing a bar includes providing a bar that is not adjustable in length.

23. The method according to claim 16, wherein providing the plurality of flower members includes providing the plurality of flower members with the curve of the shaft of the finger members having an arc shape.

24. The method according to claim 16, wherein providing the plurality of flower members includes providing the plurality of flower members including the plurality of finger members with tips having substantially a same diameter as a diameter of the shafts of the finger members closest to the tips of the finger members.

25. A fascia tissue fitness device, comprising:

a singular, linear, and uniformly dimensioned bar over a first region; and a plurality of flower members connected to said singular, linear, and uniformly dimensioned bar over the first region and along a plane, the flower members each including a plurality of finger members, the flower members further including a base extending from the bar and having a top surface and a side surface extending between the top surface and the bar, the finger members including a cylindrical shaft having a base portion and a tip portion, the base portion of the finger members extending from the side surface such that the base portion does not directly extend from the top surface, the base portion arcing toward the tip portion, the arc including a concave contour that extends from the side surface of the base to the tip portion of the finger members, and a convex contour that is opposite of the concave contour, and includes a curvature greater than a curvature of the concave contour, the convex contour extending from the side surface of the base to the tip portion of the finger members, thereby forming finger members that curve away from the base and the singular, linear, and uniformly tubular bar.

26. The fascia tissue fitness device according to claim 25, wherein the uniformly dimensioned bar over the first region has uniform thickness.

27. The fascia tissue fitness device according to claim 25, wherein the uniformly dimensioned bar over the first region is a uniformly dimensioned tubular shape.

28. The fascia tissue fitness device according to claim 25, further comprising a gripper mounted at least one end of said singular, linear, and uniformly dimensioned bar over a second region, thereby defining at least one handle region.

29. The fascia tissue fitness device according to claim 25, wherein said singular, linear, and uniformly dimensioned bar over the first region is rigid.

* * * * *